US006439177B2

(12) United States Patent
Pierik

(10) Patent No.: US 6,439,177 B2
(45) Date of Patent: Aug. 27, 2002

(54) LOW FRICTION VARIABLE VALVE ACTUATION DEVICE

(75) Inventor: Ronald J. Pierik, Rochester, NY (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 09/870,855

(22) Filed: May 30, 2001

Related U.S. Application Data

(60) Provisional application No. 60/215,253, filed on Jun. 30, 2000.

(51) Int. Cl.[7] ..... F01L 13/00

(52) U.S. Cl. ..... 123/90.16; 123/90.17; 123/90.24; 123/90.43

(58) Field of Search ..... 123/90.15, 90.16, 123/90.17, 90.22, 90.24, 90.25, 90.31, 90.39, 90.41, 90.43, 90.45, 90.46, 90.6

(56) References Cited

U.S. PATENT DOCUMENTS 4,572,118 A * 2/1986 Baguena ..... 123/90.16
6,041,746 A * 3/2000 Takemura et al. ..... 123/90.16
6,055,949 A * 5/2000 Nakamura et al. ..... 123/90.16
6,260,523 B1 * 7/2001 Nakamura et al. ..... 123/90.15
6,311,659 B1 * 11/2001 Pierik ..... 123/90.24

* cited by examiner

*Primary Examiner*—Weilun Lo
(74) *Attorney, Agent, or Firm*—John Van Ophem

(57) ABSTRACT

A variable valve train device for use on an internal combustion engine having a rotary camshaft with adjacent valve-opening and valve-closing lobes. The device is mounted on the engine head and is pivotable about the camshaft to alter the timing and lift of a fuel intake valve. A command link controls the rotational position of the apparatus with respect to the camshaft and is rotationally supported by a cylindrical shell bearing mounted on the engine head coaxial with the camshaft. The shell bearing is supported by an hydraulic lash adjuster or an adjustable ball joint to minimize mechanical lash in the device. The command link includes a ring gear which meshes with a control shaft gear for advancing or retarding the valve timing. The command link pivotably supports a rocker assembly for following the rotary motion of the valve-opening and valve-closing cam lobes. The rocker assembly is linked to an output cam disposed between the camshaft and a roller finger follower for actuating the valve.

10 Claims, 6 Drawing Sheets

LOW FRICTION VARIABLE VALVE ACTUATION DEVICE

CROSS REFERENCE TO RELATED APPLICATIONS

This application claims the benefit of U.S. Provisional Application, Ser. No. 60/215,253, filed Jun. 30, 2000.

TECHNICAL FIELD

The present invention is related to variable valve train systems for use on internal combustion engines; more particularly, to devices for controllably varying the lift of valves in such engines; and most particularly, to a variable valve train device driven by an engine camshaft and employing a command link pivotably mounted on the engine head and not on the camshaft that controllably varies the lift of the intake valves to control engine load.

BACKGROUND OF THE INVENTION

Internal combustion engine performance has progressed considerably in the past century. Inventions have yielded cleaner exhaust and enhanced durability, fuel efficiency, and power. Systems for varying the lift and timing of intake valves can further refine and enhance the performance of the internal combustion engine by controllably varying the volume of fuel mix supplied to the combustion chambers as a function of engine load and rotational speed. Fuel economy at part load operation can be increased by promoting more thorough combustion, reducing pumping work done by the pistons, which saps energy, deactivating cylinders, and/or by implementing a lean air/fuel ratio scheme. Matching the intake valve closing time more closely to the engine's need can enhance driveability of a vehicle by improving engine breathing at full engine load. Moreover, if intake and exhaust events can be controlled sufficiently to vary engine load, speed, and fuel dilution over the entire spectrum of required engine operating conditions, a controllable variable valve train can obviate the need for a throttle valve and EGR valve in a gas or diesel internal combustion engine.

A range of variable valve train (VVT) actuation devices and valve timing mechanisms for enhancing engine performance are known in the automotive art, but commercial use of such devices generally has been impractical because of cost, size, and/or operating limitations which have limited their true value and practicality. For example, variable valve actuation mechanisms, as disclosed in U.S. Pat. No. 5,937,809 issued Aug. 17, 1999 to Pierik et al. and U.S. Pat. No. 6,019,076 issued Feb. 1, 2000 to Pierik et al., the relevant disclosures of both patents being incorporated herein by reference, employ a segmented single shaft crank rocker (SSCR) for operating individual or multiple engine valves by engaging a linkage with a rotary eccentric, preferably a rotary cam, to drive an oscillatable rocker cam. The disclosed SSCR mechanism has four moving components (two arms, a rocker, and a cam) and thus can be expensive to manufacture and subject to wear at a plurality of joints. In addition, in typical prior art VVT devices, springs are required to maintain contact between an input cam and a roller follower, which springs tend to increase friction and limit maximum operating speed. Further, the coordinating frames of these devices are rotatably mounted on the camshaft itself, thus creating unavoidable and undesirable frictional losses therebetween.

It is a principal object of the present invention to provide a variable valve actuation device having reduced frictional losses when compared to prior art devices.

It is a further object of the invention to provide a variable valve train device without the need for return springs to assist the device in returning to a valve-closed position.

It is a still further object of the invention to improve peak engine torque and fuel economy.

It is a still further object of the invention to controllably vary the engine load directly at the engine cylinder, thereby potentially eliminating the need for prior art throttle body and idle air control devices.

It is a still further object of the invention to provide a variable valve train device which can be economically mass-produced for commercial use in vehicles powered by internal combustion engines.

SUMMARY OF THE INVENTION

Briefly described, a variable valve train device in accordance with the invention is provided for installation on an internal combustion engine having a rotary camshaft. In a preferred embodiment, the device is capable of interfacing with a camshaft having adjacent valve-opening and valve-closing lobes for each valve. The variable valve train device is mounted on the engine head and is pivotable about the camshaft without bearing upon the camshaft to alter the timing and lift of an engine valve, typically a fuel intake valve. A command link controlling the rotational position of the apparatus with respect to the camshaft is rotationally disposed on its outer surface in a cylindrical shell bearing mounted on the engine head coaxial with the camshaft. The shell bearing is variably supported by an hydraulic lash adjuster (HLA) or an adjustable ball joint mount, or the like, such that mechanical lash in the system may be minimized. The command link includes an arcuate ring gear portion which meshes with a control shaft gear of the engine for advancing or retarding the valve timing. The command link pivotably supports a rocker assembly having first and second rollers, or sliding pad cam followers, for following the rotary motion of valve-opening and valve-closing cam lobes. The rocker assembly is pivotably linked via an output link to an output cam element, preferably a partial cam having minimal friction dependence on the camshaft, disposed between the camshaft and a conventional roller finger follower for actuating the valve. In a preferred embodiment for controlling the motion of two parallel valves at a single engine cylinder, the output link and output cam are doubled symmetrically about the command link, and a dual rocker arm cooperates with both output links for simultaneous and identical actuation of both output cams and valves. Preferably, a plurality of cylinders in an internal combustion engine are provided with an individual device in accordance with the present invention. The disclosed invention is thus capable of controlling engine load and peak engine torque directly at the cylinder head without resort to a conventional throttle and exhaust gas recirculation (EGR) valve. The invention is also useful for variably controlling the valves of other apparatus incorporating poppet-type valves, for example, compressors for air and other gases.

BRIEF DESCRIPTION OF THE DRAWINGS

These and other features and advantages of the invention will be more fully understood and appreciated from the following description of certain exemplary embodiments of the invention taken together with the accompanying drawings, in which.

DESCRIPTION OF THE PREFERRED EMBODIMENTS

Figure 1:
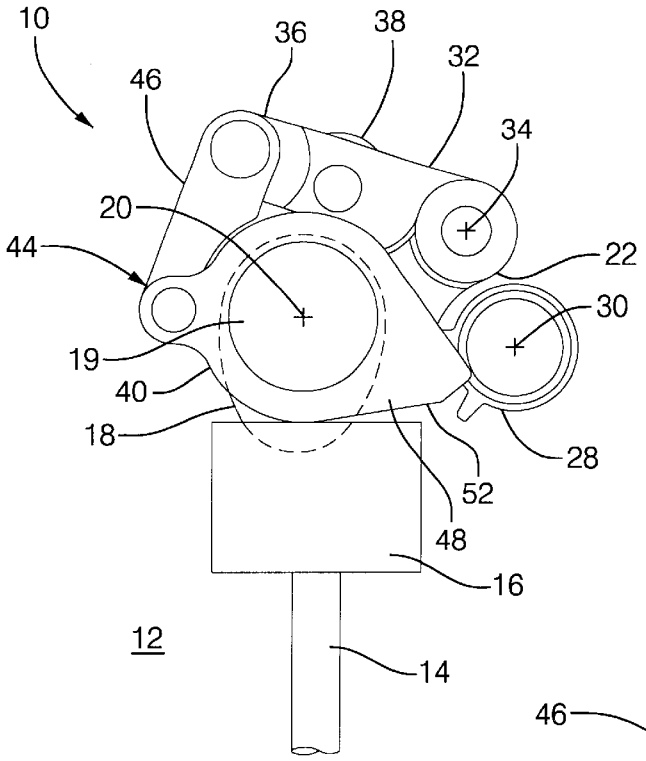
PRIOR ART FIG. 1
FIG. 1 is an end view of a prior art variable valve actuation device, shown directly actuating a single engine valve, showing the mechanism in valve-closed position.
Figure 2:
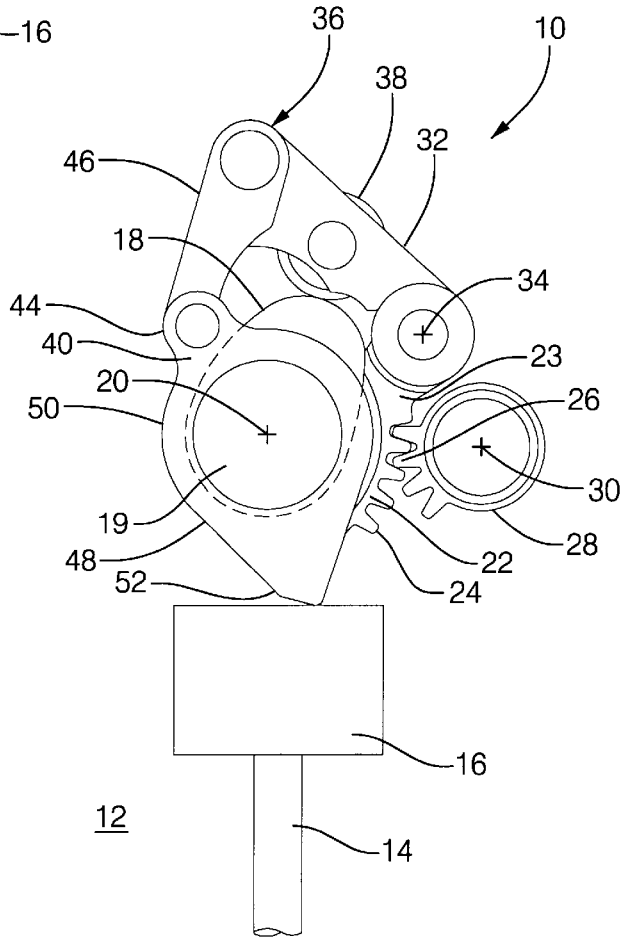
PRIOR ART FIG. 2
FIG. 2 is a view like FIG. 1, showing the mechanism in valve-open position.

The novelty and benefits of a variable valve train device in accordance with the invention may be better appreciated by first considering an analogous prior art variable valve train device as shown in FIGS. 1 and 2.

Referring to FIG. 1, numeral 10 generally indicates a prior art embodiment of a VVT device which is operable to vary valve timing and lift in an operating engine 12 having a valve 14 actuated through a follower 16. VVT device 10 includes a rotary input cam lobe 18 carried, for example, on a camshaft 19 and rotatable on a rotational primary axis 20.

Device 10 further includes a control frame 22 including a carrier link or lever 23 which is pivotable about the primary axis 20. Frame 22 is externally drivable by teeth 24 that are engaged by mating teeth 26 formed on a control gear 28 that may be oscillated about an axis 30 parallel to the primary axis. A rocker 32 is pivotably connected at one end with frame 22 at a pivot axis 34 spaced from the primary axis 20. Rocker 32 has a distal end 36 and an eccentric follower 38 in the form of a roller or other suitable means for engaging cam lobe 18 and acting as a cam follower.

A secondary lever 40 has one end mounted on and pivotable about the primary axis 20. Secondary lever 40 has a distal end 44 spaced from the axis 20 and operatively connected with the distal end 36 of rocker 32. This operative connection is made by link 46 pivotably interconnecting the two distal ends 44,36. Secondary lever 40 also includes at said one end an oscillating cam 48 having a base circle portion 50 centered on the primary axis 20 and a valve lift portion 52 extending eccentrically outward from the base circle portion. Cam 48 engages a cam follower 16, which may be a known roller finger follower, in a reciprocating motion directly acting upon valve 14 for opening and closing the valve.

Referring to FIGS. 1 and 2, in operation, the rotary cam lobe 18 is driven in timed relation with the engine crankshaft by any suitable means, such as a camshaft drive. The control member 22 is positioned in a predetermined orientation which is angularly adjustable to vary valve lift and timing but remains fixed when no change is desired. When the eccentric portion of the cam lobe 18 engages the roller follower 38, the rocker 32 is pivoted outward (up) about the pivot axis 34 located on the control member 22. This raises link 46, causing the secondary lever 40 to rotate clockwise about the primary axis 20 to slide or rock the oscillating cam 48 against the direct acting follower 16.

If the control member 22 is in a first position as shown in FIGS. 1 and 2, the clockwise lever motion causes the valve lift portion 52 of the oscillating cam 48 to actuate the follower 16 downward, opening the valve 14 to its full open position as shown in FIG. 2. Upon further rotation of the rotary cam 18, the roller follower 38 rides back down the cam 18 to its base circle. Secondary lever 40 with oscillating cam 48 pivots counterclockwise, allowing valve 14 to close as the follower 16 is again engaged by the oscillating cam base circle portion 50.

Referring to FIGS. 3 through 7, a first exemplary embodiment 110 of an improved variable valve train device is shown. Numeral 110 generally indicates an embodiment of a VVT device in accordance with the invention which is operable to vary valve timing and lift in an operating engine 12 having a valve 14 actuated by a roller finger follower 116. Engine 12 includes a valve-opening eccentric lobe 18 and an adjacent valve-closing closing lobe 21 fixedly disposed on a camshaft 19 which is rotatable on a rotational primary axis 20.

Figure 8:
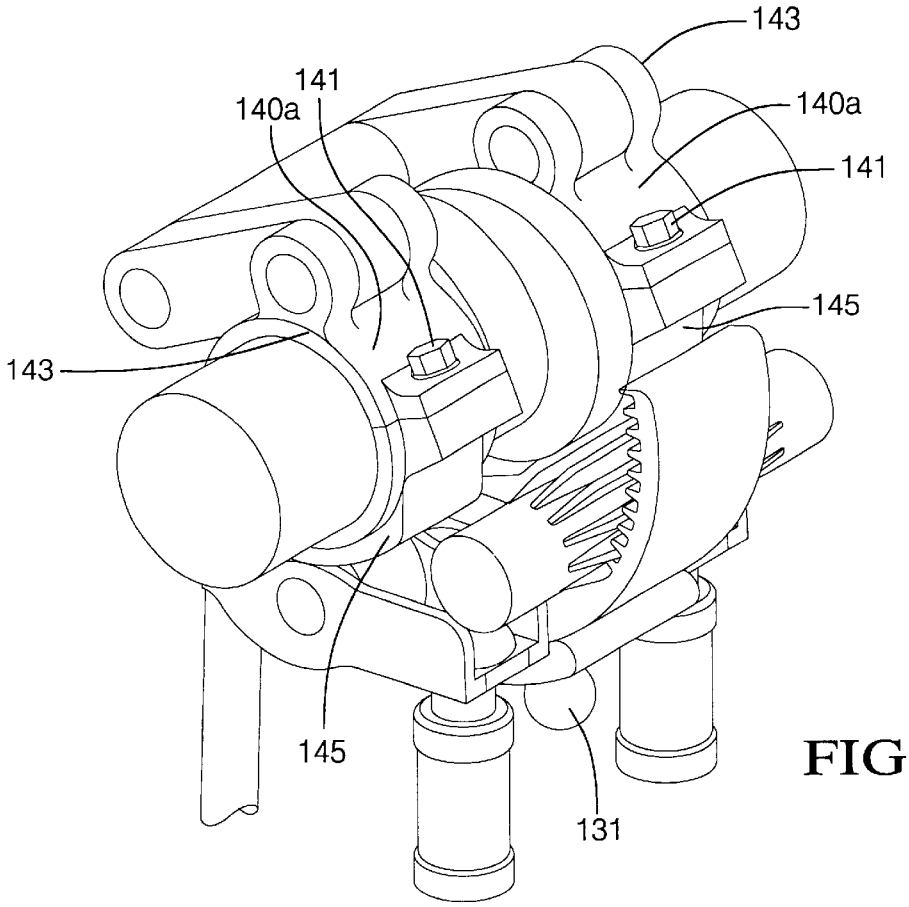
FIG. 8 is an isometric view of a second embodiment of a VVT device in accordance with the invention.
Figure 9:
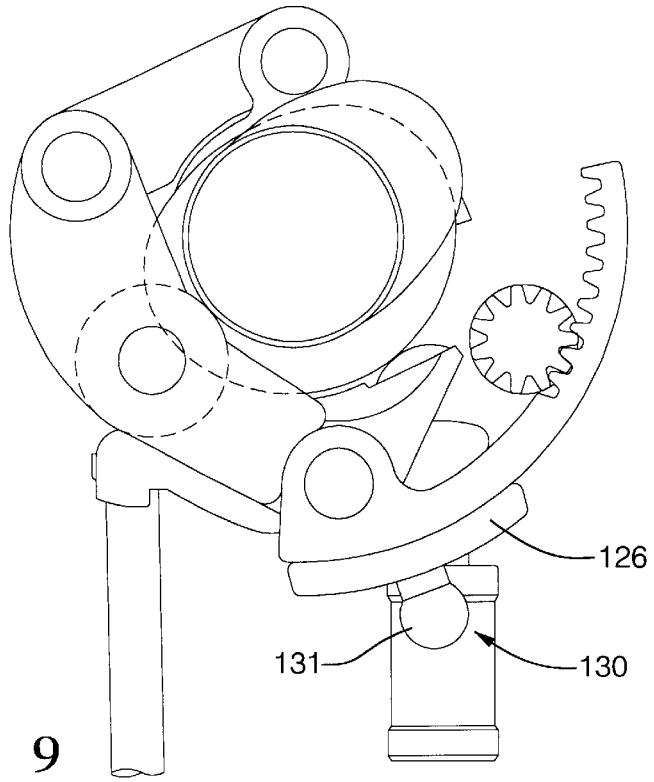
FIG. 9 is an elevational view, with some elements omitted for clarity of presentation, of the embodiment shown in FIG. 8.

Device 110 further includes a command link 122, analogous to prior art control frame 22. It is a feature of the invention that command link 122, unlike prior art control frame 22, does not bear in any way upon the camshaft and thus reduces frictional operating losses in the engine. Command link 122 is generally cylindrically arcuate about an axis coincident with primary axis 20 and has an outer bearing surface 124 which is received in a cylindrical shell bearing 126 mounted on the engine head. Bearing 126 preferably is supported adjustably to the head so that lash among the various components of VVT device 110 may be minimized. For example, bearing 126 may be supported by an hydraulic lash adjuster 128 (HLA), itself mounted in the head and drawing oil from a known gallery in the engine head. Alternatively, bearing 126 may be supported by an adjustable mount 130, as shown in FIGS. 8 and 9, wherein a ball end 131 is adjustably threaded onto bearing 126 and mates with a ball socket (not shown) in the engine head.

It is an important feature of the invention that the shell bearing 126 is adjustable radially from camshaft 19. This relaxes the manufacturing tolerances of various components of the device and permits lash between the components to be eliminated after assembly by adjustment of the support for the shell bearing. Such adjustment occurs either automatically via an hydraulic lash adjuster 128 or mechanically by screw adjustment of mount 130. Such adjustment effectively removes mechanical lash between the control shaft gear and the ring gear on the command link; between the ring gear and the rocker pin; between the rocker pin and the rocker assembly; between the valve-opening cam and its follower; and between the valve-closing cam and its follower.

A rocker assembly 132 is pivotably connected at a proximal end 133 with command link 122 at a pivot axis 134 spaced from and parallel to primary axis 20. A distal end 136 of rocker 132 is pivotably connected to link 138 which in turn is pivotably connected to a novel partial output cam 140 disposed between camshaft 19 and roller finger follower 116.

Figure 3:
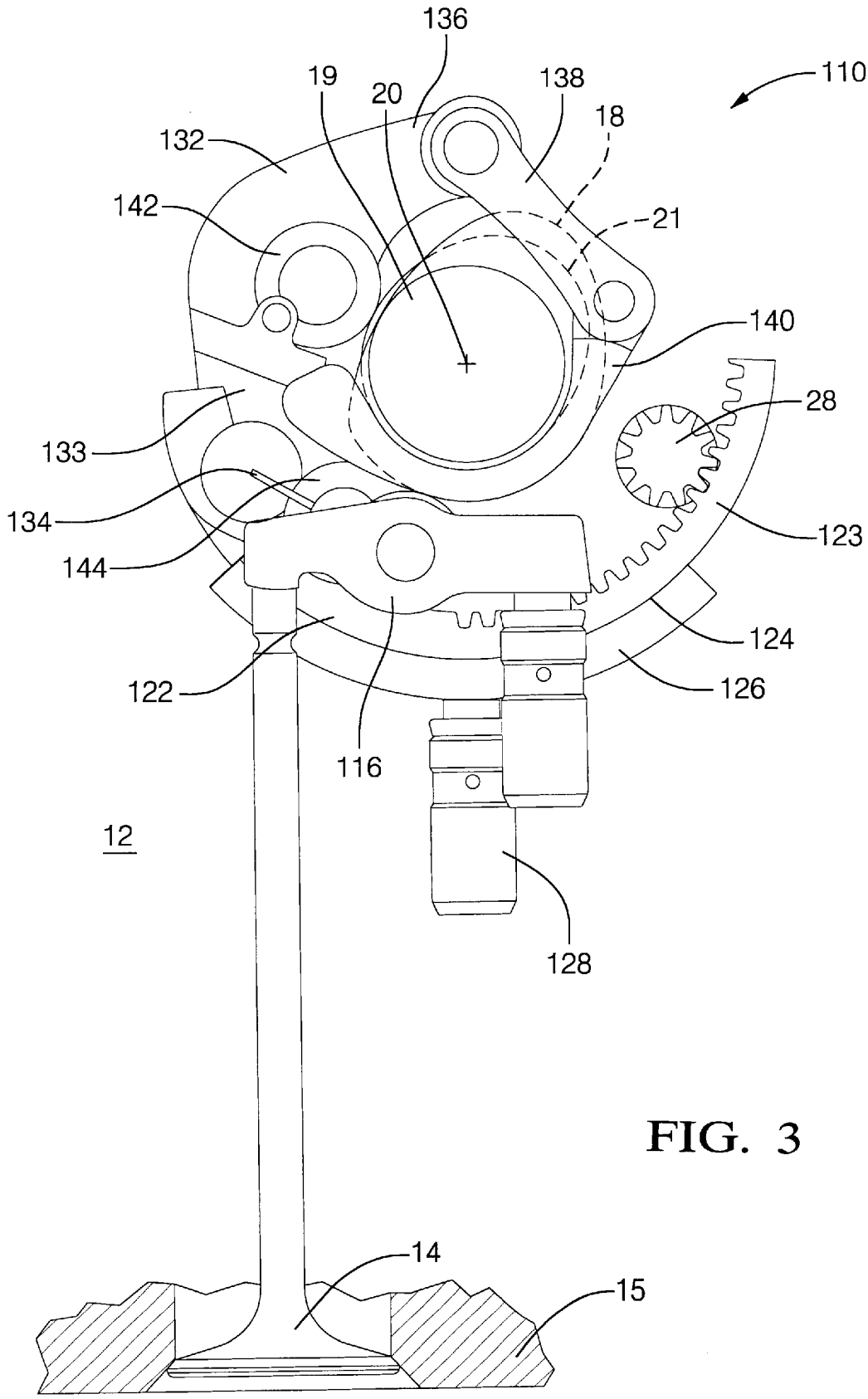
FIG. 3 is an elevational view of a first side of a VVT device in accordance with the invention directly actuating a single engine valve, showing the mechanism in a valve-closed position, comparable to the view of the prior art VVT mechanism shown in FIG. 1.
Figure 6:
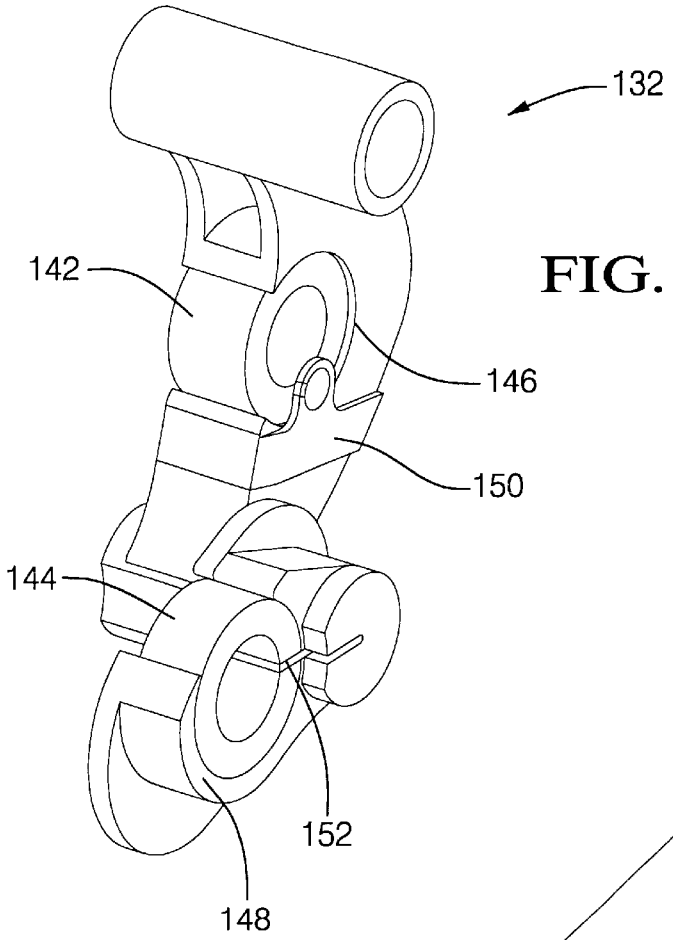
FIG. 6 is an isometric view of a rocker assembly for use in the embodiment shown in FIGS. 3 through 5.
Figure 7:
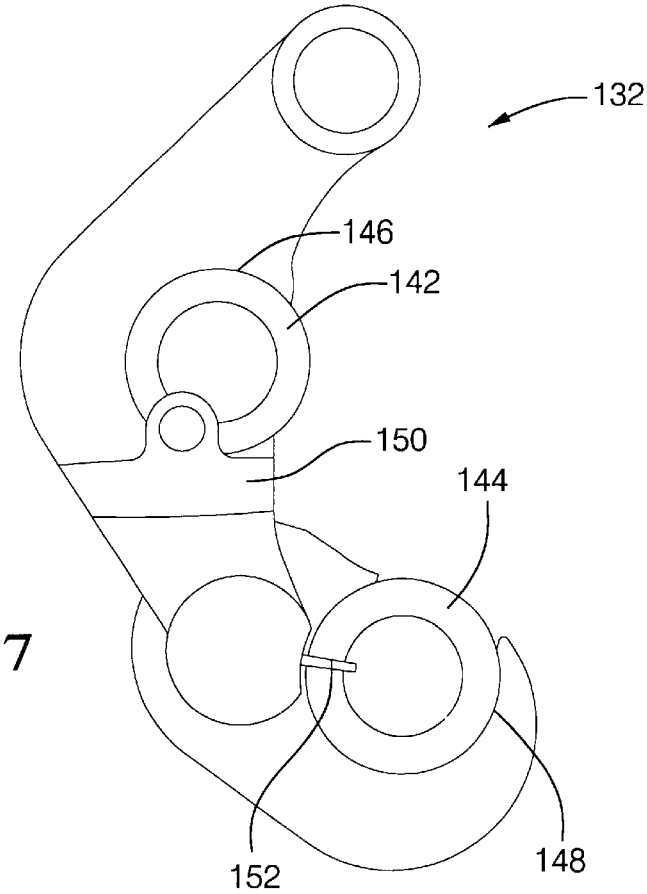
FIG. 7 is an elevational view of the rocker assembly shown in FIG. 6.

As shown in FIGS. 6 and 7, rocker assembly 132 includes a first follower, for example, first roller 142, for following valve-opening cam lobe 18; and a second follower, for example, second roller 144, for following valve-closing cam lobe 21. Preferably, each roller is supported on an outer surface thereof, rather than being axially supported, in a cylindrical bearing mount 146,148, respectively, formed in rocker assembly 132. Each roller is axially retained by a roller retainer 150,152, respectively. Referring to FIG. 3, rollers 142 and 144 are disposed on opposite sides of pivot axis 134 such that the eccentric of lobe 18 drives roller 142 away from primary axis 20, thus opening the engine valve 14, and the eccentric of lobe 21 drives roller 144 away from axis 20, thus returning the VVT linkages to the valve closed position without resort to energy-consuming return springs. The two lobes and followers thus cooperate to control at all times the action of rocker assembly 132 without springs.

Partial output cam 140 is an arcuate wedge rotationally displaceable between camshaft 19 and roller finger follower 116 to vary the spacing therebetween, and thus to control the opening and closing of valve 14, by being rotated about camshaft 19. Because cam 140 makes limited angular contact with camshaft 19, in contrast with prior art oscillating cam 48 which makes 360° contact, cam 140 can provide a significant reduction in frictional drag of apparatus 110 as compared to prior art apparatus 10. In addition, use of cam 140 reduces the number of parts and hence the cost of the device. It also enhances ease of assembly by allowing use of a one-piece camshaft because it is not required to be fitted to the camshaft itself.

In operation, camshaft 19 is driven in timed relation with the engine crankshaft by any suitable means, such as a conventional camshaft drive. Command link 122 is positioned in a predetermined orientation which is angularly adjustable by rotation of control gear 28 which meshes with ring gear portion 123 of the command link to vary valve lift and timing but remains fixed when no change is desired. As cam lobe 18 drives roller 142 outwards, the rocker assembly 132 is pivoted about the pivot axis 134 on command link 122. This causes partial output cam 140 to rotate counterclockwise (in FIGS. 3 and 4) about the primary axis 20 to displace the roller finger follower 116 away from axis 20, thus opening valve 14. Upon further rotation of camshaft 19 past the maximum eccentricity of lobe 18, roller 142 is retracted towards primary axis 20 as roller 144 is urged away from axis 20 by lobe 21. Rocker assembly 132 and link 138 urge partial output cam 140 to rotate clockwise, allowing valve 14 to close against seat 15. To reduce and control valve lift and valve open time, the control frame 122 is rotated counterclockwise, analogous to the actuation described hereinabove for prior art VVT device 10.

Figure 4:
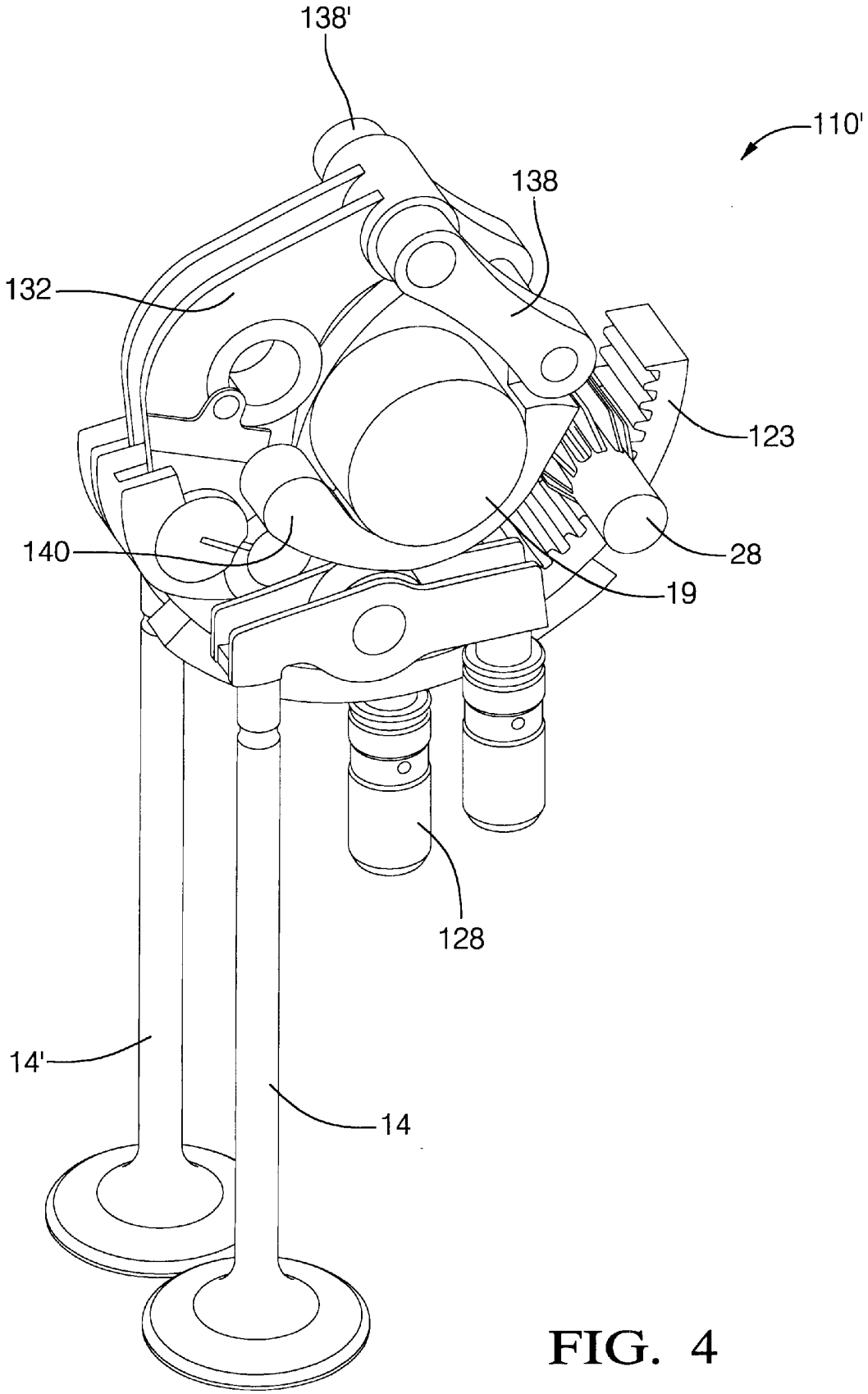
FIG. 4 is an isometric view from above of the VVT device first side shown in FIG. 3.
Figure 5:
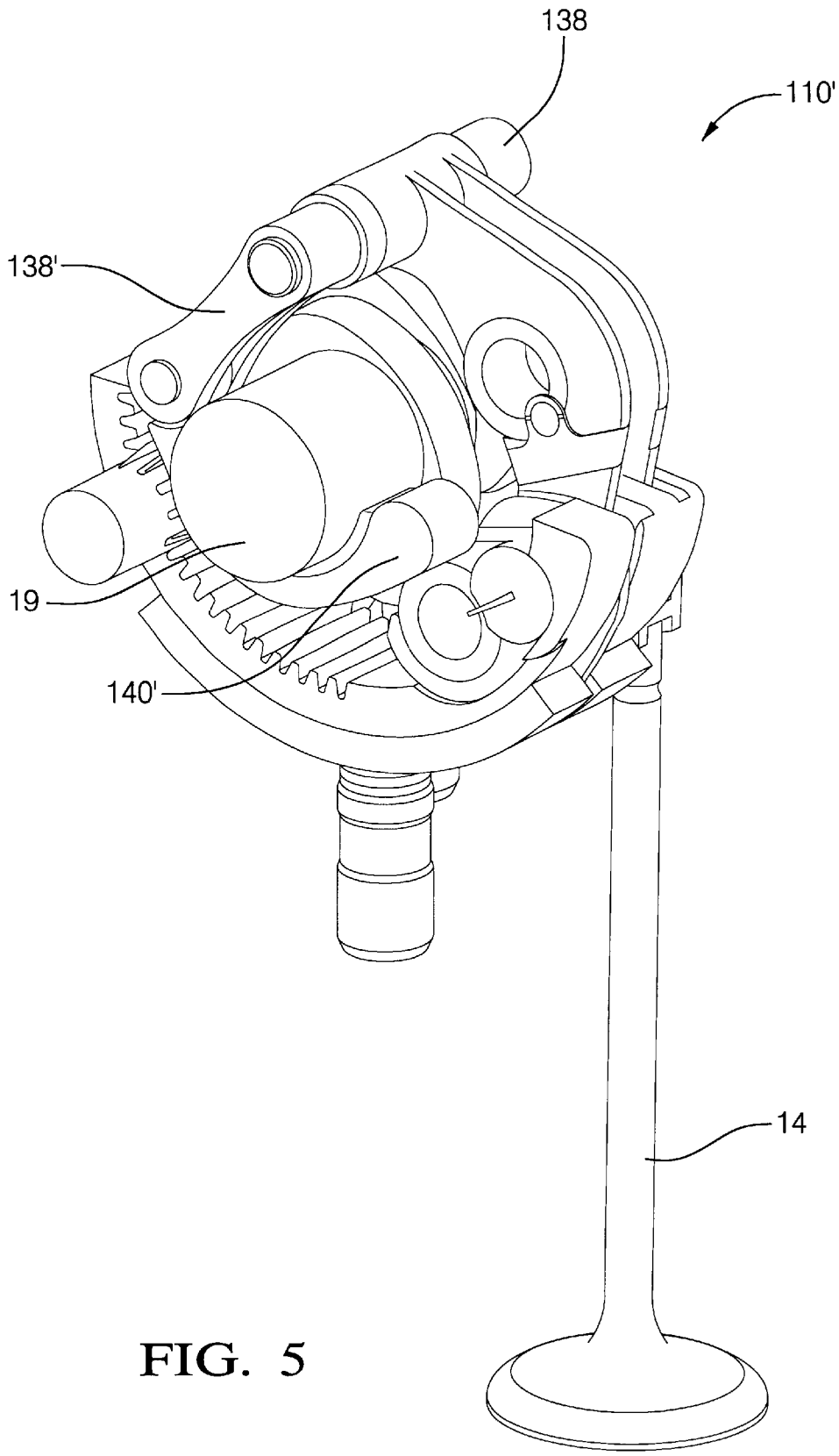
FIG. 5 is an isometric view, with some elements omitted for clarity of presentation, of the second side of the VVT device shown in FIG. 3.

As shown in FIGS. 4 and 5, a preferred embodiment 110' of the invention is adapted for actuating two valves 14,14' acting in parallel. A second link 138' is connected to rocker assembly 132 and to a second partial output cam 140' which actuates valve 14' in parallel with valve 14.

Referring to FIG. 8, partial output cam(s) 140 may be replaced alternatively by full-fitting cam(s) **140*a* connected to link(s) 138 and actuated thereby identically to cam(s) 140. Cam 140*a* is preferably formed as two portions joined around camshaft 19 as by bolts 141: a linking portion 143 and an eccentric portion 145**.

While the invention has been described by reference to various specific embodiments, it should be understood that numerous changes may be made within the spirit and scope of the inventive concepts described. Accordingly, it is intended that the invention not be limited to the described embodiments, but will have full scope defined by the language of the following claims.

What is claimed is:

1. A variable valve train device for cooperating with an input camshaft to vary the action of a cylinder valve in a head of an internal combustion engine, wherein said camshaft is provided with a valve-opening lobe and a valve-closing lobe, the device comprising:

a command link partially surrounding said camshaft and rotatably supported on an outer surface of the command link for rotation about said camshaft;

a bearing surface on the head for supporting said outer surface of the command link, wherein said command link and said bearing surface are cylindrically arcuate and the axis of said rotation is coincident with the rotation axis of said camshaft;

a rocker assembly pivotably connected to said command link and supportive of a first follower for following said valve-opening lobe and a second follower for following said valve-closing lobe;

a connecting link pivotably connected to said rocker assembly; and an output cam element pivotably connected to said connecting link and disposed against said camshaft, said output cam element being rotatable about said camshaft in response to motions of said first and second cam followers.

2. A device in accordance with claim 1 wherein said engine is provided with a second valve and second roller finger follower for actuation in parallel with the first valve, said device further comprising:

a) a second connecting link pivotably connected to said rocker assembly; and b) a second output cam element pivotably connected to said second connecting link and disposed between said camshaft and said second roller finger follower, said second cam element being rotatable about said camshaft and responsive to motions of said first and second cam followers.

3. A device in accordance with claim 1 wherein said command link includes an arcuate gear portion.

4. A device in accordance with claim 3 wherein said engine is provided with a control gear and wherein said arcuate gear portion is actuable by said control gear to vary the rotational position of said device about said camshaft to vary the action of said cylinder valve.

5. A device in accordance with claim 1 wherein said bearing surface is supported on said engine head by a support selected from the group consisting of hydraulic lash adjuster and adjustable ball-joint mount.

6. A device in accordance with claim 2 wherein said second output cam element is selected from the group consisting of partial cam and full-fitting cam.

7. A device in accordance with claim 1 wherein said output cam element is selected from the group consisting of partial cam and full-fitting cam.

8. A device in accordance with claim 1 wherein at least one of said first and second followers is a roller.

9. A device in accordance with claim 8 wherein said roller is supported for rotation on an outer surface thereof.

10. An internal combustion engine, comprising:

a) a plurality of independent cylinders and a plurality of intake valves opening upon said cylinders, said intake valves being operated by valve-opening and valve-closing eccentric lobes disposed upon a camshaft; and b) at least one variable valve train device for cooperating with said camshaft and a cylinder valve to vary the action of the valve, said device including i) a command link partially surrounding said camshaft and rotatably supported by a bearing surface on a head for rotation about said camshaft, ii) a rocker assembly pivotably connected to said command link and supportive of a first follower for following said valve-opening lobe and a second follower for following said valve-closing lobe;

iii) a connecting link pivotably connected to said rocker assembly; and iv) an output cam element pivotably connected to said connecting link and disposed between said camshaft and a roller finger follower, said cam element being rotatable about said camshaft in response to motions of said first and second cam followers.

* * * * *